US006969700B2

(12) United States Patent
Hsu et al.

(10) Patent No.: US 6,969,700 B2
(45) **Date of Patent: *Nov. 29, 2005**

(54) LIQUID DETERGENT WITH POLYANIONIC AMMONIUM SURFACTANT AND A HIGH PKA SOLID INORGANIC BASE

(75) Inventors: Gregory Hsu, Tenafly, NJ (US); Guanglin Sun, Branchburg, NJ (US); Feng-Lung Gordon Hsu, Tenafly, NJ (US)

(73) Assignee: Unilever Home & Personal Care, USA Division of Conopco, Inc, Greenwich, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/777,573

(22) Filed: Feb. 12, 2004

(65) Prior Publication Data

US 2005/0181965 A1 Aug. 18, 2005

(51) Int. Cl.[7] ..... C11D 17/00
(52) U.S. Cl. ..... 510/357; 510/394; 510/424; 510/499; 510/494
(58) Field of Search ..... 510/267, 424, 510/426, 499, 357, 394, 494

(56) References Cited

U.S. PATENT DOCUMENTS

| | | | | |
|---|---|---|---|---|
| 4,597,898 | A | 7/1986 | Vander Meer | 252/529 |
| 4,622,378 | A | 11/1986 | Gosselink | 528/66 |
| 4,664,848 | A | 5/1987 | Oh et al. | 252/547 |
| 5,669,984 | A | 9/1997 | Scheibel et al. | 134/25.2 |
| 6,121,226 | A | 9/2000 | Gosselink et al. | 510/400 |

FOREIGN PATENT DOCUMENTS

| | | |
|---|---|---|
| EP | 137 615 | 4/1985 |
| EP | 688 859 | 12/1995 |
| WO | 97/43366 | 11/1997 |
| WO | 98/00508 | 1/1998 |
| WO | 99/49009 | 9/1999 |
| WO | 00/63334 | 10/2000 |

OTHER PUBLICATIONS

PCT International Search Report in a PCT application PCT/EP2005/001172.
PCT International Search Report in a PCT application PCT/EP2005/000115.
PCT International Search Report in a PCT application PCT/EP2004/009268.
Japanese Abstract JP 09 003483—published Jan. 7, 1997.

*Primary Examiner*—Necholus Ogden
(74) *Attorney, Agent, or Firm*—Rimma Mitelman

(57) ABSTRACT

A liquid laundry detergent composition comprising from about 0.1% to about 80%, by weight of the composition, of a polyanionic ammonium surfactant; a substantially non-aqueous carrier; and a solid inorganic base having pKa equal to or greater than 10.

9 Claims, No Drawings

LIQUID DETERGENT WITH POLYANIONIC AMMONIUM SURFACTANT AND A HIGH PKA SOLID INORGANIC BASE

FIELD OF THE INVENTION

The present invention relates to liquid detergent compositions comprising a polyanionic ammonium surfactant and a high pKa solid inorganic base.

BACKGROUND OF THE INVENTION

Liquid detergents are popular with the consumers. Despite numerous liquid detergent products on the market, however, a continuous consumer need exists for improved performance, especially if such can be achieved at a lower cost.

Specifically, consumers look for improved soil removal and improved whiteness and brightness, without having to pay a premium for such benefits. Polyamines, such as tetraethylene pentamine ("TEPA"), are known in petroleum production and refining operations as corrosion inhibitors, demulsifiers, neutralizers, and functional additives.

Laundry applications use modified polyamines. See for instance, WO 00/63334, EP 137 615, U.S. Pat. No. 5,669,984, U.S. Pat. No. 4,664,848, WO 99/49009, U.S. Pat. No. 6,121,226, U.S. Pat. No. 4,622,378, and U.S. Pat. No. 4,597,898. Some of these documents describe aqueous detergent compositions which also incorporate anionic surfactants or fatty acids, or anionic surfactant precursors, in the presence also of strong caustic agents which are added to produce anionic surfactants from anionic surfactant acid precursors or fatty acid salts from fatty acids. The present invention is based at least in part on the discovery that polyanionic ammonium surfactants employed in the present invention exhibit different characteristics and perform substantially better at soil removal than physical mixtures of anionic surfactants/fatty acids and polyamines. Furthermore, in the inventive compositions polyanionic ammonium surfactants can co-exist with a strong inorganic base to offer higher buffering capacity and high wash pH for improved performance.

SUMMARY OF THE INVENTION

The present invention includes a liquid detergent composition comprising:

(a) from about 0.1% to about 80%, by weight of the composition, of a polyanionic ammonium surfactant;

(b) a liquid carrier comprising at most about 5% water;

(c) from about 0.1 to about 10% of a solid inorganic base having pKa equal to or greater than 10.

The compositions are especially useful for cleaning fabrics or hard surfaces.

DETAILED DESCRIPTION OF THE INVENTION

Except in the operating and comparative examples, or where otherwise explicitly indicated, all numbers in this description indicating amounts of material or conditions of reaction, physical properties of materials and/or use are to be understood as modified by the word "about." All amounts are by weight of the liquid detergent composition, unless otherwise specified.

It should be noted that in specifying any range of concentration, any particular upper concentration can be associated with any particular lower concentration.

For the avoidance of doubt the word "comprising" is intended to mean "including" but not necessarily "consisting of" or "composed of." In other words, the listed steps or options need not be exhaustive.

"Liquid" as used herein means that a continuous phase or predominant part of the composition is liquid and that a composition is flowable at 15° C. and above (i.e., suspended solids may be included). Gels are included in the definition of liquid compositions as used herein.

Polyanionic Ammonium Surfactant ("PAAS")

The polyanionic ammonium surfactants suitable for use herein contain units having the structure formula:

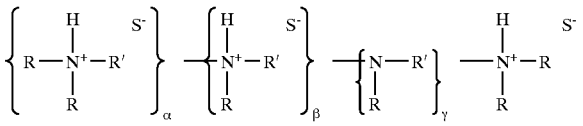

Where R is selected from hydrogen, linear or branched $C_1$–$C_4$ alkyl, $C_7$–$C_{12}$ Alkylaryl, $C_2$–$C_{12}$ alkylene, $C_3$–$C_{12}$ hydroxyalkylene, $C_4$–$C_{12}$ dihydroxyalkylene, $C_8$–$C_{12}$ Dialkylarylene, and

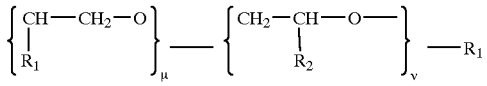

where $\mu$ and $\nu$ are in the range of 0 to 4 and the sum of $\mu$ and $\nu$ are between 1 and 4. $R_1$ is selected from hydrogen, linear or branched $C_1$–$C_4$ alkyl, $C_6$–$C_{12}$ Alkylaryl, $C_2$–$C_{12}$ Alkylene, $C_3$–$C_{12}$ hydroxyalkylene, $C_4$–$C_{12}$ dihydroxyalkylene and $C_8$–$C_{12}$ Dialkylarylene;

R2 is selected from R1 and amine oxide;

R' is a linking connecting the nitrogen atoms of the backbone. R' units are selected from $C_2$–$C_{12}$ alkylene, $C_4$–$C_{12}$ alkenylene, $C_3$–$C_{12}$ hydroxyalkylene wherein the hydroxyl moiety may take any position on the R' unit chain except the carbon atoms directly connected to the polyamine backbone nitrogen; $C_4$–$C_{12}$ dihydroxyalkylene wherein the hydroxyl moieties may occupy any two of the carbon atoms of the R' unit chain except those carbon atoms directly connected to the backbone nitrogen. The values of $\alpha$, $\beta$, and $\gamma$ are between 0 to 10 and the sum of $\alpha$ and $\beta$ is greater than or equal to 1. The total number of amine groups for the present invention is between 2 to 10.

$S^-$ is a conjugated base of anionic surfactant acid ($S^-$—$H^+$) with a HLB number in the range of 2 to 45.

$S^-$ may be expressed as $$R_3—L^-$$

Where $R_3$ is selected from straight or branched $C_6$–$C_{22}$ alkyl, $C_6$–$C_{22}$ Alkylene, $C_6$–$C_{22}$ polyoxyalkylenealkyl, $C_6$–$C_{22}$ polyoxyalkylenatacyl, $C_6$–$C_{22}$ alkylaryl, Rosin derivatives, $C_6$–$C_{22}$ N-acylalkyl; $C_6$–$C_{22}$ $\alpha$-sulfonated-talkyl, $C_6$–$C_{22}$ hydroxyalkyl, and $C_6$–$C_{22}$ hydroxyalkylene;

Where $L^-$ is selected from $COO^-$, $SO_3^-$, $OSO3^-$, phosphoric acid, phosphorous acid, amino acids, aromatic carboxylic acid, sugar base acids derived from oxidation of monosaccharides and polysaccharides.

The preferred PAAS in the inventive compositions is selected from polyanionic ammonium alkyl benzene sulfonate, polyanionic ammonium alkyl sulfate, polyanionic ammonium fatty acid salt, polyanionic ammonium alkyl polyalkoxy sulfate and mixtures thereof.

The amount of PAAS employed in the inventive compositions is in the range of from 0.1% to 80%, preferably from 1% to 60%, most preferably from 5% to 40%.

PAAS can be prepared by reacting a polyamine with the conjugate acid of an anionic surfactant, e.g. LAS acid, fatty acid, LES acid and others.

Liquid Carrier

The inventive compositions are liquid and therefore contain a liquid carrier. PAAS is generally dispersed or dissolved in the liquid carrier, for optimum performance. A liquid carrier is a liquid at and above 15° C., preferably above 10° C., and most preferably above 0° C.

The liquid carrier in the inventive compositions is substantially non-aqueous, i.e. it contains at most 5%, preferably less than 3%, more preferably less than 1%, and optimally less than 0.5% of water. The amount of water referred to herein includes bound water.

It was previously believed that a polyanionic ammonium surfactant (PAAS) cannot co-exist with a strong base (other than polyamine bases) because the ion-pair nature of PAAS would be broken and replaced by a strong base. The inventors surprisingly discovered that a liquid detergent containing PAAS can be manufactured containing a high pKa base, in a format of non-aqueous or substantially non-aqueous liquid detergent. It is believed, although not wishing to be bound by this theory, that by virtue of excluding or severely limiting the amount of water, whatever little water is present in the inventive compositions, it is trapped within the surfactant reverse micelle or presented in the form of bound water, and thus the trapped water is not available to dissolve inorganic bases—thus, the ion-pair of PAAS may be maintained.

Other liquid components, such as solvents, surfactants, liquid organic matters including organic bases, and their mixtures can form the liquid carrier.

Solvents that may be present include but are not limited to alcohols, liquid surfactant, or liquid surfactant mixes, alkanol amine, polyamine, other polar or non-polar solvents, and mixtures thereof. The liquid carrier is employed in an amount of from 20% to 99.9%.

Strong Base

"Strong Base" as used herein means a solid inorganic base with pKa equal to or greater than 10.

Examples of strong inorganic bases include but are not limited to alkaline hydroxides, such as sodium hydroxide, potassium hydroxide, lithium hydroxide; alkaline carbonate, such as sodium carbonate, potassium carbonate, sodium hydride, alkaline carbonate, sodium silicates (e.g., sodium metasilicate), alkaline pyrophosphate.

pKa values of some commonly used bases are given in the table below for easy reference. The strong bases such as alkali hydroxide, are fully dissociated in water, and pH value depends on the concentration of the strong base. According to Organic Chemistry (John McMurry, Organic Chemistry, p. 45, Brooks/Cole Publishing Company, 1984), ethoxide $CH_3CH_2O^-$, and hydroxide $OH^-$ have pKa values of 16 and 15.74, respectively. Correspondingly, the pH values for 0.01 N KOH and NaOH are 12.0, and their 1.0 N aqueous solutions have a pH of 14.0.

| Base | pKa |
|---|---|
| $M^+OH^-$ | 15.74 |
| $M_2CO_3$ | 10.33 |
| $M_3PO_4$ | 12.32 |
| $M_4SiO_4$ | 12.00 |
| $M_3HSiO_4$ | 12.00 |
| $M_2H_2SiO_4$ | 11.8 |

From CRC Handbook of Chemistry and Physics, 83rd Edition

The "base" as discussed herein means the base added as a free base.

The strong base is included in the inventive compositions in an amount of from 0.1 to 10, preferably from 1 to 6, most preferably from 2 to 4% in order to offer the optimized performance and cost. The amount of strong base referred herein does not include bound water.

Particle Size

In order to avoid the sedimentation of the strong base, the average particle size of the inorganic solid particles is preferably less than 500 microns, preferably less than 300 microns, more preferably less than 100 microns, and most preferably less than 10 microns. For particles less than 10 microns may be suspended by the Brownian motion phenomena. Structuring of non-aqueous liquid PAAS composition, such as the incorporation of fine particles, may be needed for suspension of larger particles. On the other hand, when present as relatively small particles, the solid inorganic base may itself function as a structuring system, for other ingredients.

Process of Making

The inventive process includes contacting a polyamine and a conjugate acid of an anionic surfactant, preferably in the absence or in substantial absence of free water.

Typically, 100% of a conjugate acid of an anionic surfactant is employed. The polyamine is employed in the amount of from about 10% to about 50%, preferably from 15% to 45%, most preferably from 20% to 40%, of the molar equivalent of the amount of the conjugate acid of a polyamine during the formation of PASS. Additional polyamine or other nitrogen based bases may be added after the formation of PAAS.

A preferred process includes first preparing a main mix by mixing propylene glycol, nonionic surfactants and anionic surfactant acids, including fatty acid. A polyamine, e.g. TEPA (tetraethylenepentamine) is then added to the main mix. Mixing is continued until both acids are fully dispersed and consumed. Nonionic surfactant may be added before, during or after the addition of anionic surfactant acids. Optionally, a solubiliser, e.g. alkyl ether sulfate ammonium salt or nonionic surfactant, is then added to the main mix and the mixing is continued so as to form a homogeneous solution. If included, Fluorescent Whitening agent is then added to the mixture. The mixing is continued until a homogeneous liquid detergent composition is formed. Separately, a high pKA base solid is preferably pre-ground down to the size less than 500 microns, preferably less than 300 microns, most preferably less than 100 microns. The solid base is added at any point after the PAAS has been formed. Enzyme or some functional polymers may also be incorporated as fine powders.

Optional Ingredients

The inventive compositions may include non-neutralized polyamine and alkyl benzene sulfonate salts and/or alkyl sulfate salts and/or fatty acid salts, in addition to the PAAS surfactant of the present invention.

Solubilizer

Unlike liquid polyamines, the PAAS is a solid by itself. However, it may be solubilized in a solubilizer. Hence, the inventive non-aqueous compositions, preferably include a solubilizer for PAAS. The solubilizer is selected from the group consisting of liquid surfactants, solvents (such as propylene glycol, glycerin, and ethanol), and the mixture of them, and is preferably selected from nonionic surfactants (such as C8–C18 Alkane with 5–15 EO groups) and/or alkyl polyethoxy sulfate, due to their ability to help in the formation of the mixed micelles while having great solubilizing ability.

For an isotropic non-aqueous liquid detergent, the minimum ratio of solubilizer to PAAS is 1:10, generally in the range of from 1:10 to 10:1, by weight percentage; preferably in the range of from 1:5 to 5:1, and most preferably from 1:2 to 2:1. However, PAAS can also be dispersed or dispensed in a liquid detergent medium, therefore no additional solubilizer in addition to the surfactants used in the composition is needed to obtain the cleaning performance.

Additional Surfactant

The compositions of the invention may, but do not have to contain additional surface active agents selected from the group consisting of anionic, nonionic, cationic, ampholytic and zwitterionic surfactants or mixtures thereof. The preferred surfactant detergents for use in the present invention are mixtures of anionic and nonionic surfactants although it is to be understood that any surfactant may be used alone or in combination with any other surfactant or surfactants.

Anionic Surfactant Detergents

Anionic surface active agents which may be used in the present invention are those surface active compounds which contain a long chain hydrocarbon hydrophobic group in their molecular structure and a hydrophilic group, i.e. water solubilizing group such as carboxylate, sulfonate or sulfate group or their corresponding acid form. The anionic surface active agents include the alkali metal (e.g. sodium and potassium) and nitrogen based bases (e.g. mono-amines and polyamines) salts of water soluble higher alkyl aryl sulfonates, alkyl sulfonates, alkyl sulfates and the alkyl poly ether sulfates. They may also include fatty acid or fatty acid soaps. One of the preferred groups of mono-anionic surface active agents are the alkali metal, ammonium or alkanolamine salts of higher alkyl aryl sulfonates and alkali metal, ammonium or alkanolamine salts of higher alkyl sulfates or the mono-anionic polyamine salts. Preferred higher alkyl sulfates are those in which the alkyl groups contain 8 to 26 carbon atoms, preferably 12 to 22 carbon atoms and more preferably 14 to 18 carbon atoms. The alkyl group in the alkyl aryl sulfonate preferably contains 8 to 16 carbon atoms and more preferably 10 to 15 carbon atoms. A particularly preferred alkyl aryl sulfonate is the sodium, potassium or ethanolamine $C_{10}$ to $C_{16}$ benzene sulfonate, e.g. sodium linear dodecyl benzene sulfonate. The primary and secondary alkyl sulfates can be made by reacting long chain olefins with sulfites or bisulfites, e.g. sodium bisulfite. The alkyl sulfonates can also be made by reacting long chain normal paraffin hydrocarbons with sulfur dioxide and oxygen as describe in U.S. Pat. Nos. 2,503,280, 2,507,088, 3,372,188 and 3,260,741 to obtain normal or secondary higher alkyl sulfates suitable for use as surfactant detergents.

The alkyl substituent is preferably linear, i.e. normal alkyl, however, branched chain alkyl sulfonates can be employed, although they are not as good with respect to biodegradability. The alkane, i.e. alkyl, substituent may be terminally sulfonated or may be joined, for example, to the 2-carbon atom of the chain, i.e. may be a secondary sulfonate. It is understood in the art that the substituent may be joined to any carbon on the alkyl chain. The higher alkyl sulfonates can be used as the alkali metal salts, such as sodium and potassium. The preferred salts are the sodium salts. The preferred alkyl sulfonates are the $C_{10}$ to $C_{18}$ primary normal alkyl sodium and potassium sulfonates, with the $C_{10}$ to $C_{15}$ primary normal alkyl sulfonate salt being more preferred.

Mixtures of higher alkyl benzene sulfonates and higher alkyl sulfates can be used as well as mixtures of higher alkyl benzene sulfonates and higher alkyl polyether sulfates.

The alkali metal or ethanolamine sulfate can be used in admixture with the alkylbenzene sulfonate in an amount of 0 to 70%, preferably 5 to 50% by weight.

The higher alkyl polyethoxy sulfates used in accordance with the present invention can be normal or branched chain alkyl and contain lower alkoxy groups which can contain two or three carbon atoms. The normal higher alkyl polyether sulfates are preferred in that they have a higher degree of biodegradability than the branched chain alkyl and the lower poly alkoxy groups are preferably ethoxy groups.

The preferred higher alkyl polyethoxy sulfates used in accordance with the present invention are represented by the formula:

$$R^1—O(CH_2CH_2O)_p—SO_3M,$$

where $R^1$ is $C_8$ to $C_{20}$ alkyl, preferably $C_{10}$ to $C_{18}$ and more preferably $C_{12}$ to $C_{15}$; p is 1 to 8, preferably 2 to 6, and more preferably 2 to 4; and M is an alkali metal, such as sodium and potassium, an ammonium cation or polyamine. The sodium and potassium salts, and polyaimines are preferred.

A preferred higher alkyl poly ethoxylated sulfate is the sodium salt of a triethoxy $C_{12}$ to $C_{15}$ alcohol sulfate having the formula:

$$C_{12\text{-}15}—O—(CH_2CH_2O)_3—SO_3Na$$

Examples of suitable alkyl ethoxy sulfates that can be used in accordance with the present invention are $C_{12\text{-}15}$ normal or primary alkyl triethoxy sulfate, sodium salt; n-decyl diethoxy sulfate, sodium salt; $C_{12}$ primary alkyl diethoxy sulfate, ammonium salt; $C_{12}$ primary alkyl triethoxy sulfate, sodium salt; $C_{15}$ primary alkyl tetraethoxy sulfate, sodium salt; mixed $C_{14\text{-}15}$ normal primary alkyl mixed tri- and tetraethoxy sulfate, sodium salt; stearyl pentaethoxy sulfate, sodium salt; and mixed $C_{10\text{-}18}$ normal primary alkyl triethoxy sulfate, potassium salt.

The normal alkyl ethoxy sulfates are readily biodegradable and are preferred. The alkyl poly-lower alkoxy sulfates can be used in mixtures with each other and/or in mixtures with the above discussed higher alkyl benzene, sulfonates, or alkyl sulfates.

The alkali metal higher alkyl poly ethoxy sulfate can be used with the alkylbenzene sulfonate and/or with an alkyl sulfate, in an amount of 0 to 70%, preferably 5 to 50% and more preferably 5 to 20% by weight of entire composition.

Nonionic Surfactant

Nonionic surfactants which can be used with the invention, alone or in combination with other surfactants are described below.

As is well known, the nonionic surfactants are characterized by the presence of a hydrophobic group and an organic hydrophilic group and are typically produced by the condensation of an organic aliphatic or alkyl aromatic hydrophobic compound with ethylene oxide (hydrophilic in nature). Typical suitable nonionic surfactants are those disclosed in U.S. Pat. Nos. 4,316,812 and 3,630,929, incorporated by reference herein.

Usually, the nonionic surfactants are polyalkoxylated lipophiles wherein the desired hydrophile-lipophile balance is obtained from addition of a hydrophilic poly-alkoxy group to a lipophilic moiety. A preferred class of nonionic detergent is the alkoxylated alkanols wherein the alkanol is of 9 to 20 carbon atoms and wherein the number of moles of alkylene oxide (of 2 or 3 carbon atoms) is from 3 to 20. Of such materials it is preferred to employ those wherein the alkanol is a fatty alcohol of 9 to 11 or 12 to 15 carbon atoms and which contain from 5 to 9 or 5 to 12 alkoxy groups per mole. Also preferred is paraffin—based alcohol (e.g. nonionics from Huntsman or Sassol).

Exemplary of such compounds are those wherein the alkanol is of 10 to 15 carbon atoms and which contain about 5 to 12 ethylene oxide groups per mole, e.g. Neodol® 25-9 and Neodol® 23-6.5, which products are made by Shell Chemical Company, Inc. The former is a condensation product of a mixture of higher fatty alcohols averaging about 12 to 15 carbon atoms, with about 9 moles of ethylene oxide and the latter is a corresponding mixture wherein the carbon atoms content of the higher fatty alcohol is 12 to 13 and the number of ethylene oxide groups present averages about 6.5. The higher alcohols are primary alkanols.

Another subclass of alkoxylated surfactants which can be used contain a precise alkyl chain length rather than an alkyl chain distribution of the alkoxylated surfactants described above. Typically, these are referred to as narrow range alkoxylates. Examples of these include the Neodol-1$^{(R)}$ series of surfactants manufactured by Shell Chemical Company.

Other useful nonionics are represented by the commercially well known class of nonionics sold under the trademark Plurafac® by BASF. The Plurafacs® are the reaction products of a higher linear alcohol and a mixture of ethylene and propylene oxides, containing a mixed chain of ethylene oxide and propylene oxide, terminated by a hydroxyl group. Examples include $C_{13}$–$C_{15}$ fatty alcohol condensed with 6 moles ethylene oxide and 3 moles propylene oxide, $C_{13}$–$C_{15}$ fatty alcohol condensed with 7 moles propylene oxide and 4 moles ethylene oxide, $C_{13}$–$C_{15}$ fatty alcohol condensed with 5 moles propylene oxide and 10 moles ethylene oxide or mixtures of any of the above.

Another group of liquid nonionics are commercially available from Shell Chemical Company, Inc. under the Dobanol® or Neodol® trademark: Dobanol® 91-5 is an ethoxylated $C_9$–$C_{11}$ fatty alcohol with an average of 5 moles ethylene oxide and Dobanol® 25-7 is an ethoxylated $C_{12}$–$C_{15}$ fatty alcohol with an average of 7 moles ethylene oxide per mole of fatty alcohol.

In the compositions of this invention, preferred nonionic surfactants include the $C_{12}$–$C_{15}$ primary fatty alcohols with relatively narrow contents of ethylene oxide in the range of from about 6 to 9 moles, and the $C_9$ to $C_{11}$ fatty alcohols ethoxylated with about 5–6 moles ethylene oxide.

Another class of nonionic surfactants which can be used in accordance with this invention are glycoside surfactants. Glycoside surfactants suitable for use in accordance with the present invention include those of the formula:

$$RO—(R^2O)_y—(Z)_x$$

wherein R is a monovalent organic radical containing from about 6 to about 30 (preferably from about 8 to about 18) carbon atoms; $R^2$ is a divalent hydrocarbon radical containing from about 2 to 4 carbons atoms; O is an oxygen atom; y is a number which can have an average value of from 0 to about 12 but which is most preferably zero; Z is a moiety derived from a reducing saccharide containing 5 or 6 carbon atoms; and x is a number having an average value of from 1 to about 10 (preferably from about 1½ to about 10).

A particularly preferred group of glycoside surfactants for use in the practice of this invention includes those of the formula above in which R is a monovalent organic radical (linear or branched) containing from about 6 to about 18 (especially from about 8 to about 18) carbon atoms; y is zero; z is glucose or a moiety derived therefrom; x is a number having an average value of from 1 to about 4 (preferably from about 1½ to 4).

Nonionic surfactants which may be used include polyhydroxy amides as discussed in U.S. Pat. No. 5,312,954 to Letton et al. and aldobionamides such as disclosed in U.S. Pat. No. 5,389,279 to Au et al., both of which are hereby incorporated by reference into the subject application.

Generally, nonionics would comprise 0–75% by wt., preferably 5 to 50%, more preferably 5 to 25% by wt. of the composition.

Mixtures of two or more of the nonionic surfactants can be used.

Cationic Surfactants

Many cationic surfactants are known in the art, and almost any cationic surfactant having at least one long chain alkyl group of about 10 to 24 carbon atoms is suitable in the present invention. Such compounds are described in "Cationic Surfactants", Jungermann, 1970, incorporated by reference.

Specific cationic surfactants which can be used as surfactants in the subject invention are described in detail in U.S. Pat. No. 4,497,718, hereby incorporated by reference.

As with the nonionic and anionic surfactants, the compositions of the invention may use cationic surfactants alone or in combination with any of the other surfactants known in the art. Of course, the compositions may contain no cationic surfactants at all.

Amphoteric Surfactants

Ampholytic synthetic surfactants can be broadly described as derivatives of aliphatic or aliphatic derivatives of heterocyclic secondary and tertiary amines in which the aliphatic radical may be straight chain or branched and wherein one of the aliphatic substituents contains from about 8 to 18 carbon atoms and at least one contains an anionic water-soluble group, e.g. carboxylate, sulfonate, sulfate. Examples of compounds falling within this definition are sodium 3-(dodecylamino)propionate, sodium 3-(dodecylamino)propane-1-sulfonate, sodium 2-(dodecylamino)ethyl sulfate, sodium 2-(dimethylamino)octadecanoate, disodium 3-(N-carboxymethyldodecylamino)propane 1-sulfonate, disodium octadecyl-imminodiacetate, sodium 1-carboxymethyl-2-undecylimidazole, and sodium N,N-bis(2-hydroxyethyl)-2-sulfato-3-dodecoxypropylamine. Sodium 3(dodecylamino)propane-1-sulfonate is preferred.

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. The cationic atom in the quaternary compound can be part of a heterocyclic ring. In all of these compounds there is at least one aliphatic group, straight chain or branched, containing from about 3 to 18 carbon atoms and at least one aliphatic substituent containing an anionic water-solubilizing group, e.g., carboxy, sulfonate, sulfate, phosphate, or phosphonate.

Specific examples of zwitterionic surfactants which may be used are set forth in U.S. Pat. No. 4,062,647, hereby incorporated by reference.

The amount of additional surfactant used may vary from 1 to 85% by weight, preferably 10 to 50% by weight.

As noted the preferred surfactant systems of the invention are mixtures of anionic and nonionic surfactants.

Preferably, the nonionic should comprise, as a percentage of an anionic/nonionic system, at least 20%, more preferably at least 25%, up to about 75% of the total surfactant system. A particularly preferred surfactant system comprises anionic:nonionic in a ratio of 3:1.

Builders/Electrolytes

Builders which can be used according to this invention include conventional alkaline detergency builders, inorganic or organic, which should be used at levels from about 0.1% to about 20.0% by weight of the composition, preferably from 1.0% to about 10.0% by weight, more preferably 2% to 5% by weight.

As electrolyte may be used any water-soluble salt. Electrolyte may also be a detergency builder, such as the inorganic builder sodium tripolyphosphate, or it may be a non-functional electrolyte such as sodium sulphate or chloride. Preferably the inorganic builder comprises all or part of the electrolyte. That is the term electrolyte encompasses both builders and salts.

Examples of suitable inorganic alkaline detergency builders which may be used are water-soluble alkalimetal phosphates, polyphosphates, borates, silicates and also carbonates. Specific examples of such salts are sodium and potassium triphosphates, pyrophosphates, orthophosphates, hexametaphosphates, tetraborates, silicates and carbonates.

Examples of suitable organic alkaline detergency builder salts are: (1) water-soluble amino polycarboxylates, e.g., sodium and potassium ethylenediaminetetraacetates, nitrilotriacetatesand N-(2 hydroxyethyl)-nitrilodiacetates; (2) water-soluble salts of phytic acid, e.g., sodium and potassium phytates (see U.S. Pat. No. 2,379,942); (3) water-soluble polyphosphonates, including specifically, sodium, potassium and lithium salts of ethane-1-hydroxy-1,1-diphosphonic acid; sodium, potassium and lithium salts of methylene diphosphonic acid; sodium, potassium and lithium salts of ethylene diphosphonic acid; and sodium, potassium and lithium salts of ethane-1,1,2-triphosphonic acid. Other examples include the alkali metal salts of ethane-2-carboxy-1,1-diphosphonic acid hydroxymethanediphosphonic acid, carboxyldiphosphonic acid, ethane-1-hydroxy-1,1,2-triphosphonic acid, ethane-2-hydroxy-1,1,2-triphosphonic acid, propane-1,1,3,3-tetraphosphonic acid, propane-1,1,2,3-tetraphosphonic acid, and propane-1,2,2,3-tetraphosphonic acid; (4) water-soluble salts of polycarboxylate polymers and copolymers as described in U.S. Pat. No. 3,308,067.

In addition, polycarboxylate builders can be used satisfactorily, including water-soluble salts of mellitic acid, citric acid, and carboxymethyloxysuccinic acid, imino disuccinate, salts of polymers of itaconic acid and maleic acid, tartrate monosuccinate, tartrate disuccinate and mixtures thereof.

Sodium citrate is particularly preferred, to optimize the function vs. cost, in an amount of from 0 to 15%, preferably from 1 to 10%.

Certain zeolites or aluminosilicates can be used. One such aluminosilicate which is useful in the compositions of the invention is an amorphous water-insoluble hydrated compound of the formula $Na_x(_yAlO_2.SiO_2)$, wherein x is a number from 1.0 to 1.2 and y is 1, said amorphous material being further characterized by a Mg++ exchange capacity of from about 50 mg eq. $CaCO_3$/g. and a particle diameter of from about 0.01 micron to about 5 microns. This ion exchange builder is more fully described in British Pat. No. 1,470,250.

A second water-insoluble synthetic aluminosilicate ion exchange material useful herein is crystalline in nature and has the formula $Na_z[(AlO_2)_y.(SiO_2)]xH_2O$, wherein z and y are integers of at least 6; the molar ratio of z to y is in the range from 1.0 to about 0.5, and x is an integer from about 15 to about 264; said aluminosilicate ion exchange material having a particle size diameter from about 0.1 micron to about 100 microns; a calcium ion exchange capacity on an anhydrous basis of at least about 200 milligrams equivalent of $CaCO_3$ hardness per gram; and a calcium exchange rate on an anhydrous basis of at least about 2 grains/gallon/minute/gram. These synthetic aluminosilicates are more fully described in British Patent No. 1,429,143.

Alkalinity buffers which may be added to the compositions of the invention include monoethanolamine, triethanolamine, borax and the like. Inorganic buffers may be added in substantially free of free water form.

Enzymes

One or more enzymes as described in detail below, may be used in the compositions of the invention.

If a lipase is used, the lipolytic enzyme may be either a fungal lipase producible by *Humicola lanuginosa* and *Thermomyces lanuginosus*, or a bacterial lipase which show a positive immunological cross-reaction with the antibody of the lipase produced by the microorganism *Chromobacter viscosum* var. *lipolyticum* NRRL B-3673.

An example of a fungal lipase as defined above is the lipase ex *Humicola lanuginosa*, available from Amano under the tradename Amano CE; the lipase ex *Humicola lanuginosa* as described in the aforesaid European Patent Application 0,258,068 (NOVO), as well as the lipase obtained by cloning the gene from *Humicola lanuginosa* and expressing this gene in *Aspergillus oryzae*, commercially available from Novozymes under the tradename "Lipolase". This lipolase is a preferred lipase for use in the present invention.

While various specific lipase enzymes have been described above, it is to be understood that any lipase which can confer the desired lipolytic activity to the composition may be used and the invention is not intended to be limited in any way by specific choice of lipase enzyme.

The lipases of this embodiment of the invention are included in the liquid detergent composition in such an amount that the final composition has a lipolytic enzyme activity of from 100 to 0.005 LU/ml in the wash cycle, preferably 25 to 0.05 LU/ml when the formulation is dosed at a level of about 0.1–10, more preferably 0.5–7, most preferably 1–2 g/liter.

Naturally, mixtures of the above lipases can be used. The lipases can be used in their non-purified form or in a purified form, e.g. purified with the aid of well-known absorption methods, such as phenyl sepharose absorption techniques.

If a protease is used, the proteolytic enzyme can be of vegetable, animal or microorganism origin. Preferably, it is of the latter origin, which includes yeasts, fungi, molds and bacteria. Particularly preferred are bacterial subtilisin type proteases, obtained from e.g. particular strains of *B. subtilis* and *B licheniformis*. Examples of suitable commercially available proteases are Alcalase®, Savinase®, Esperase®, all of Novozymes; Maxatase® and Maxacal® of Gist-Brocades; Kazusase® of Showa Denko. The amount of proteolytic enzyme, included in the composition, ranges from 0.05–50,000 GU/mg. preferably 0.1 to 50 GU/mg, based on the final composition. Naturally, mixtures of different proteolytic enzymes may be used.

While various specific enzymes have been described above, it is to be understood that any protease which can confer the desired proteolytic activity to the composition may be used and this embodiment of the invention is not limited in any way be specific choice of proteolytic enzyme.

In addition to lipases or proteases, it is to be understood that other enzymes such as cellulases, oxidases, amylases, peroxidases and the like which are well known in the art may also be used with the composition of the invention. The enzymes may be used together with co-factors required to promote enzyme activity, i.e., they may be used in enzyme systems, if required. It should also be understood that enzymes having mutations at various positions (e.g., enzymes engineered for performance and/or stability enhancement) are also contemplated by the invention.

The enzyme stabilization system may be included, although by virtue of being substantially non-aqueous, the inventive compositions do not actually require enzyme stabilization. Enzyme stabilization systems include comprise propylene glycol and/or short chain carboxylic acids.

One preferred stabilization system is a polyol in combination with boric acid. Preferably, the weight ratio of polyol to boric acid added is at least 1, more preferably at least about 1.3.

Clay

Other materials such as clays, particularly of the water-insoluble types, may be useful adjuncts in compositions of this invention. Particularly useful is bentonite. This material is primarily montmorillonite which is a hydrated aluminum silicate in which about ⅙th of the aluminum atoms may be replaced by magnesium atoms and with which varying amounts of hydrogen, sodium, potassium, calcium, etc. may be loosely combined. The bentonite in its more purified form (i.e. free from any grit, sand, etc.) suitable for detergents contains at least 50% montmorillonite and thus its cation exchange capacity is at least about 50 to 75 meq per 100 g of bentonite. Particularly preferred bentonites are the Wyoming or Western U.S. bentonites which have been sold as Thixo-jels 1, 2, 3 and 4 by Georgia Kaolin Co. These bentonites are known to soften textiles as described in British Patent No. 401, 413 to Marriott and British Patent No. 461,221 to Marriott and Guam.

Fluorescent Whitening Agent ("FWA")

When intended as laundry detergents, the inventive compositions preferably include from 0.01% to 2.0%, more preferably from 0.05% to 1.0%, most preferably from 0.05% to 0.5% of a fluorescer. Examples of suitable fluorescers include but are not limited to derivative of stilbene, pyrazoline, coumarin, carboxylic acid, methinecyamines, dibenzothiophene-5,5-dioxide azoles, 5-, and 6-membered-ring heterocycles, triazole and benzidine sulfone compositions, especially sulfonated substituted triazinyl stilbene, sulfonated naphthotriazole stilbene, benzidene sulfone, etc. Most preferred are UV/stable brighteners (for compositions visible in transparent containers), such as distyrylbiphenyl derivatives (Tinopal® CBS-X).

Minor Ingredients

In addition, various other detergent additives or adjuvants may be present in the detergent product to give it additional desired properties, either of functional or aesthetic nature.

In the compositions of the present invention that are intended as laundry compositions, there also may be included in the formulation, minor amounts of soil suspending or anti-redeposition agents, e.g. polyvinyl alcohol, fatty amides, sodium carboxymethyl cellulose, hydroxy-propyl methyl cellulose. A preferred anti-redeposition agent is sodium carboxylmethyl cellulose having a 2:1 ratio of CM/MC which is sold under the tradename Relatin DM 4050.

Anti-foam agents, e.g. silicon compounds, such as Silicane® L 7604, can also be added in small effective amounts, although it should be noted that the inventive compositions are low-foaming.

Bactericides, e.g. tetrachlorosalicylanilide and hexachlorophene, fungicides, dyes, pigments (water dispersible), preservatives, e.g. formalin, ultraviolet absorbers, anti-yellowing agents, such as sodium carboxymethyl cellulose, pH modifiers and pH buffers, color safe bleaches, perfume and dyes and bluing agents such as Iragon Blue L2D, Detergent Blue 472/572 and ultramarine blue can be used.

Also, additional soil release polymers and cationic softening agents may be used.

Preferably, the detergent composition is a colored composition packaged in the transparent/translucent ("see-through") container.

Container

Preferred containers are transparent/translucent bottles. "Transparent" as used herein includes both transparent and translucent and means that a composition, or a package according to the invention preferably has a transmittance of more than 25%, more preferably more than 30%, most preferably more than 40%, optimally more than 50% in the visible part of the spectrum (approx. 410–800 nm). Alternatively, absorbency may be measured as less than 0.6 (approximately equivalent to 25% transmitting) or by having transmittance greater than 25% wherein % transmittance equals: $1/10^{absorbancy} \times 100\%$. For purposes of the invention, as long as one wavelength in the visible light range has greater than 25% transmittance, it is considered to be transparent/translucent.

Transparent bottle materials with which this invention may be used include, but are not limited to: polypropylene (PP), polyethylene (PE), polycarbonate (PC), polyamides (PA) and/or polyethylene terephthalate (PETE), polyvinylchloride (PVC); and polystyrene (PS).

The preferred inventive compositions which are packaged into transparent containers include an opacifier to impart a pleasing appearance to the product. The inclusion of the opacifier is particularly beneficial when the liquid detergent compositions in the transparent containers are in colored. The preferred opacifier is styrene/acrylic copolymer. The opacifier is employed in amount of from 0.0001 to 1%, preferably from 0.0001 to 0.2%, most preferably from 0.0001 to 0.04%.

The container of the present invention may be of any form or size suitable for storing and packaging liquids for household use. For example, the container may have any size but usually the container will have a maximal capacity of 0.05 to 15 L, preferably, 0.1 to 5 L, more preferably from 0.2 to 2.5 L. Preferably, the container is suitable for easy handling. For example the container may have handle or a part with such dimensions to allow easy lifting or carrying the container with one hand. The container preferably has a means suitable for pouring the liquid detergent composition and means for reclosing the container. The pouring means may be of any size of form but, preferably will be wide enough for convenient dosing the liquid detergent composition. The closing means may be of any form or size but usually will be screwed or clicked on the container to close the container. The closing means may be cap which can be detached from the container. Alternatively, the cap can still be attached to the container, whether the container is open or closed. The closing means may also be incorporated in the container.

Method of Using Compositions

The compositions are intended to be used for cleaning of fabrics (e.g., laundry, carpets, draperies) or hard surfaces (e.g., in the bathroom or kitchen). For laundry compositions, the indicated quantity of the composition (generally in the range from 50 to 200 ml) depending on the size of the laundry load, the size and type of the washing machine, is added to the washing machine which also contains water and the soiled laundry. The inventive laundry compositions are particularly suited for use with front-loading washing machine, due to the ability of the inventive compositions to deliver high performance with low foaming—front-loading machines require low foaming compositions.

The following specific examples further illustrate the invention, but the invention is not limited thereto.

The abbreviations in the Examples denote the following:

TEPA: Tetraethylenepentamine

NA-LAS: Sodium alkylbenzenesufonate

LAS acid: alkylbenzenesulfonic acid

Na-LES: Sodium alkylpolyethoxysulfate

Neodol® 25-7: 7-EO $C_{12}$–$C_{15}$ fatty alcohol

Neodol® 25-9: 9-EO $C_{12}$–$C_{15}$ fatty alcohol

EXAMPLE 1 AND COMPARATIVE EXAMPLE 1A

This example demonstrates one of the differences in one of the physical properties (water solubility) between PAAS surfactant employed in the present invention and TEPA and Na-LAS mixtures in the prior art.

In Example 1, when LAS acid was neutralized with a polyamine (i.e., TEPA), it formed PAAS. As PAAS began forming, the solution became hazy. Upon further addition of the LAS acid, the hazy solution became a dispersion. Upon standing for hours, the dispersion formed a layer of sediment at the bottom of the beaker. Even a very diluted formulation (such as below 0.1%) was hazy.

TEPA has multiple nitrogen sites. Without wishing to be limited by this theory, it is believed that upon continued addition of LAS acid, the PAAS formed different compounds and gave different assemblies. At the beginning of addition of LAS acid, only single nitrogen atom was protonated, forming a micellar solution, which is a clear solution. Upon the addition of more LAS acid, multiple nitrogen atoms were protonated. PAAS eventually precipitated from the solution because of the lack of ionization of the PAAS due to the strong ion-bond formation between LAS and TEPA and internal hydrophobic interaction.

In Example 1A the behavior was completely different: Na-LAS solution with added TEPA gave a clear solution throughout the titration of LAS acid and remained clear upon addition of TEPA.

The solution was clear at the all time over the entire pH range, leading to the conclusion that Na-LAS was fully ionized or disassociated. The clarity of solution did not change upon the addition of TEPA for the pH from 2.5 to 10.0. It indicates that the addition of TEPA does not convert Na-LAS to PAAS.

This means that PAAS formed much stronger assemblies than Na-LAS and TEPA physical mixture. PAAS could not be dispersed in single molecular state but dispersed as aggregates.

The results that were obtained for Examples 1 and 1A are summarised in Tables 1 and 1A respectively.

TABLE 1

| Ingredient | Wt (g) | Observations |
|---|---|---|
| Water | 94.0 | Clear |
| TEPA | 2.0 | Clear |
| LAS acid | 2.6 | Hazy solution, pH 10.50 |
| | 6.0 | Hazy dispersion, pH 9.95 |
| | 7.4 | Dispersion, pH 9.60 |
| | 9.0 | Dispersion, pH 9.03, after standing hours at room temperature precipitate was formed on the bottom of the beaker. |

TABLE 1A

| Ingredient | Wt (g) | Results |
|---|---|---|
| Water | 96.00 | |
| NaOH, 50% | 1.60 | |
| LAS acid | 6.38 | pH = 2.5; a clear solution |
| TEPA | 0.11 | pH = 7.78; a clear solution |
| | 0.15 | pH = 10.0; a clear solution |

EXAMPLE 2

Example 2 demonstrates that PAAS surfactant is a strongly bonded molecule, which does not exchange counterions with other salts. Sodium xylenesulfonate was added to an aqueous PAAS dispersion to attempt to solubilize PAAS by ion-exchange and/or hydrotrope mechanism. The results that were obtained are summarised in Table 2.

TABLE 2

| Ingredient | Wt (g) | Observations |
|---|---|---|
| PAAS preparation | | |
| Water | 98.0 | |
| LAS acid | 6.38 | |
| TEPA | 2.0 | PAAS formed (7.8% concentration). Looked as milky dispersion. After standing several days at room temperature, precipitate was formed. |
| PAAS (7.8%) | 20.0 | |
| Water | 300.0 | |
| Sodium xylenesulfonate (40%) | 20.5 | still hazy and eventually TEPA-LAS precipitates are found in the solution |

The concentration of PAAS in the above formulation was 0.46%. The molar ratio of sodium xylenesulfonate to PAAS was 21:1.

There was enough Na xylenesulfonate for PAAS to change counter ions from TEPA to Na. However, PAAS did not ionize and remained as a dispersion. It indicated that the bond between polyamine and conjugated acid of PAAS is very strong.

EXAMPLE 3

Example 1 was repeated, except that fatty acid was used in place of LAS acid. A phenomenon similar to that of Example 1 (formation of a dispersion insoluble in water) was observed for the product of fatty acid and polyamine. The results that were obtained are summarised in Table 3.

TABLE 3

| Ingredient | Wt (g) | Observations |
|---|---|---|
| Water | 92.0 | |
| Coco acid | 10.35 | |
| TEPA | 2.6 | Hazy solution, |
| | 3.15 | Hazy dispersion, and after standing, a phase separation occurred (precipitates formed in the bottom). |

EXAMPLES 4–7

The liquid base was prepared by adding nonionic, LAS acid, fatty acid, propylene glycol and polyamine to the main mix tank, followed by the addition of F-dye, colorant, perfume and other functional ingredients. Sodium carbonate was ground down by a set of mortal and pestle, followed by sieving through No. 325 mesh screen.

Thus, the particle size of carbonate was less than 44 microns. These fine carbonate particles were then added and mixed into the liquid detergent base.

| Example<br>Ingredient | 4<br>% | 5<br>% | 6<br>% | 7<br>% |
|---|---|---|---|---|
| Neodol ® 25-7 | 46.5 | 36.0 | — | 46.5 |
| Neodol ® 25-9 | — | — | 37.2 | |
| LAS acid, 95.5% | 35.8 | 36.0 | 37.2 | 34.0 |
| Coco fatty acid | | | | 3.0 |
| TEPA | 10.8 | 10.8 | 11.2 | 11.0 |
| Propylene Glycol | — | 7.9 | 8.2 | 8.0 |
| Fluorescent Whitening Agent | 0.8 | 0.8 | 0.8 | 0.8 |
| perfume | 0.8 | 0.8 | 0.8 | 0.8 |
| Sodium Carbonate | 4.8 | 4.8 | 4.4 | 4.6 |
| Miscellaneous | To 100% | To 100% | To 100% | To 100% |

COMPARATIVE EXAMPLE B

The composition of Example 5 was prepared via a different procedure. Propylene glycol and LAS acid were added and mixed in a main mix first, followed by the addition of the half amounts of Neodol 25-7. After the all ingredients were well mixed in the main mix, sodium carbonate was then added slowly with medium agitation. Gradually, the temperature of the main mix slightly increased accompanied with the formation of foam. This indicated the reaction between LAS acid and carbonate and the formation of Na-LAS, water and $CO_2$. After one-hour reaction time, the remaining Neodol 25-7 was added and followed by TEPA. The addition of TEPA destroyed the foam. FWA and perfume were added at last.

There was no foam formation or heat generation during the addition of sodium carbonate in Examples 4–7, which indicates that sodium carbonate remained as inert particles in the inventive compositions.

It should be understood that the specific forms of the invention herein illustrated and described are intended to be representative only. Changes, including but not limited to those suggested in this specification, may be made in the illustrated embodiments without departing from the clear teachings of the disclosure. Accordingly, reference should be made to the following appended claims in determining the full scope of the invention.

What is claimed is:

1. A liquid detergent composition comprising:

(a) from about 0.1% to about 80%, by weight of the composition, of a polyanionic ammonium surfactant;

(b) a liquid carrier comprising at most about 5% water;

(c) from about 0.1 to about 10% of a solid inorganic base having pKa equal to or greater than 10.

2. The composition of claim 1 wherein the polyanionic ammonium surfactant is selected from the group consisting of polyanionic ammonium alkyl benzene sulfonate, polyanionic ammonium alkyl sulfate, polyanionic ammonium fatty acid salt, polyanionic ammonium alkyl polyalkoxy sulfate and mixtures thereof.

3. The composition of claim 1 wherein the polyanionic ammonium surfactant is dispersed in a liquid carrier.

4. The composition of claim 1 wherein the polyanionic ammonium surfactant is solubilized in a liquid carrier.

5. The composition of claim 4 further comprising a solubilizing agent.

6. The composition of claim 5 wherein the weight ratio of the solubilizing agent to the polyanionic ammonium surfactant is in the range of from 1:10 to 10:1.

7. The composition of claim 1 wherein the inorganic base has a particle size less than 500 microns.

8. The composition of claim 1 wherein the inorganic base is sodium carbonate.

9. A method of washing laundry in a front-loading washing machine, the method comprising adding to the washing machine the composition of claim 1.

* * * * *